United States Patent [19]

Fottner et al.

[11] 4,101,215

[45] Jul. 18, 1978

[54] CLEANING DEVICE FOR AN ELECTROSTATIC COPIER

[75] Inventors: Günther Fottner; Gottfried Waibel, both of Munich, Fed. Rep. of Germany

[73] Assignee: AGFA-Gevaert A.G., Leverkusen, Fed. Rep. of Germany

[21] Appl. No.: 750,804

[22] Filed: Dec. 15, 1976

[30] Foreign Application Priority Data

Dec. 20, 1975 [DE] Fed. Rep. of Germany ..... 2557758

[51] Int. Cl.[2] ..... G03G 21/00

[52] U.S. Cl. ..... 355/15; 15/1.5 R; 15/256.52; 118/652

[58] Field of Search ..... 355/3 R, 15; 118/652; 15/1.5, 256.51, 256.52

[56] References Cited

U.S. PATENT DOCUMENTS

| | | | |
|---|---|---|---|
| 2,752,271 | 6/1956 | Walkup et al. | 355/15 X |
| 3,641,979 | 2/1972 | Gerbasi et al. | 118/652 X |
| 3,655,373 | 4/1972 | Fisher et al. | 15/1.5 X |
| 3,807,853 | 4/1974 | Hudson | 355/15 |
| 3,879,785 | 4/1975 | Roth et al. | 355/15 X |
| 3,884,572 | 5/1975 | Bacon et al. | 15/1.5 X |
| 3,927,937 | 12/1975 | deKeyzer | 355/15 |

*Primary Examiner*—Fred L. Braun
*Attorney, Agent, or Firm*—Michael J. Striker

[57] ABSTRACT

An electrostatic copier has a travelling endless carrier on the photoconductive surface of which an electrostatic image pattern can be formed. Toner particles are electrostatically attracted to this pattern so as to form a visible image on the surface and are thereupon transferred to an image carrier. The photosensitive surface is then cleaned of residual toner particles in preparation for the next image formation. For the cleaning operation a mechanical wiper is in contact with the photosensitive surface and wipes the residual toner particles off the same; most of these particles adhere to the wiper and are then dislodged from their positions on the same and thereupon accelerated through space toward a container by the action of an electric field which is established intermediate the wiper and the container.

22 Claims, 4 Drawing Figures

CLEANING DEVICE FOR AN ELECTROSTATIC COPIER

BACKGROUND OF THE INVENTION

The present invention relates to an electrostatic copier, and more especially to an electrostatic copier of the type having a device for removing residual toner particles from the photoconductive surface of a travelling endless image-pattern carrier.

Electrostatic copiers are known per se and their construction and basic operation need not be described. It will suffice to point out that after an image has been formed on the electrostatically charged photoconductive surface of the carrier and this image has thereafter been transferred to the image carrier, some residual toner particles will continue to adhere to the photoconductive surface. These particles must be removed before the next image-pattern is formed on the photoconductive surface, because their presence would lead to smeared or otherwise unsatisfactory images during succeeding operations of the copier.

It has been proposed to remove these residual toner particles from the photoconductive surface by a cleaning roller which mechanically brushes the surface and picks up the particles from the same. These particles are then transferred from the roller to a strip-shaped fibrous web that is incrementally withdrawn from a supply roller and taken up on a take-up roller. Such an arrangement would have the advantage of successively presenting clean portions of the incrementally advanced web to the cleaning roller from which they pick up the toner particles. However, such operation results, of course, in exhaustion of the web supply on the supply roller and necessitates a relatively frequent replacement of the empty supply roller with a refilled new supply roller. This not only leads to the need to constantly replace the web as a consumable commodity, but also requires that the cleaning device be withdrawn from the copier housing, the used web be removed, a fresh supply roller be installed and the leading end of the fresh web be connected to the take-up roll before the device can be reinserted into the copier housing. All of this is relatively complicated and most certainly time-consuming. Therefore, this proposal does not represent the optimum desired solution which should make operation as simple as possible for the user and should, ideally, remove or reduce to a minimum the use of consumable commodities in connection with the cleaning operation.

Another previous proposal seeks to remove residual toner particles from the cleaning roller by means of a doctor blade. This, however, is quite unsatisfactory because some of the particles removed from the cleaning roller inevitably adhere to the doctor blade. Since this effect is cumulative, the doctor blade becomes so encrusted with adhereing particles over a period of time, that in relatively short order the cleaning effectiveness has dropped to a totally unsatisfactory level.

SUMMARY OF THE INVENTION

In view of the shortcomings of the prior proposals, it is an object of the present invention to overcome the drawbacks presented by these shortcomings and to provide an improved cleaning device for electrostatic copiers.

More particularly, it is an object of the invention to provide such an improved cleaning device which eliminates or at least reduces to a minimum the use of consumable materials.

Another object is to provide such an improved cleaning device which requires very little maintenance.

A concomitant object is to provide a cleaning device of the type outlined above, which is simple in construction and highly reliable in operation.

Still a further object of the invention is to provide such a cleaning device which offers significantly improved cleaning effectiveness.

In keeping with these objects, and with others which will become apparent hereafter, one feature of the invention provides, in an electrostatic copier wherein an electrostatic image pattern is formed on the photoconductive surface of a travelling endless carrier, toner particles are electrostatically attracted to the pattern to form a visible image and are thereupon transferred to an image carrier and cleaning means subsequently cleans incremental portions of the photoconductive surface to remove residual toner particles therefrom which then become lodged on the cleaning means, the improvement comprising means for dislodging toner particles from the cleaning means; a receptacle spaced from the dislodging means; and means for generating an electric field which attracts dislodged particles and impels them towards the generating means for eventual deposition in the receptacle.

In operation of the device outlined above the cleaning means removes the residual toner particles from the photoconductive surface of the image-forming drum or otherwise-shaped carrier. These particles now adhere to the cleaning means, mostly due to electrostatic attraction. The dislodging means dislodges some of these particles outright, i.e., it causes them to drop off the cleaning means. Others of the particles are at least dislodged from their positions on the cleaning means, i.e., they are shifted from one position to another on the cleaning means, at least to some slight extent. Such shifting is sufficient to significantly decrease the adherence of these particles to the cleaning means. All of the particles are, in any event, subjected to the force exerted by the electric field produced by the generating means, and this force is sufficient to attract them towards the generating means and to accelerate them accordingly in direction away from the cleaning means and in a sense leading to their eventual deposition in the receptacle. The latter is advantageously so positioned that it is readily accessible from the exterior of the copier. Such a receptacle may be a cup, a bag or the like.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
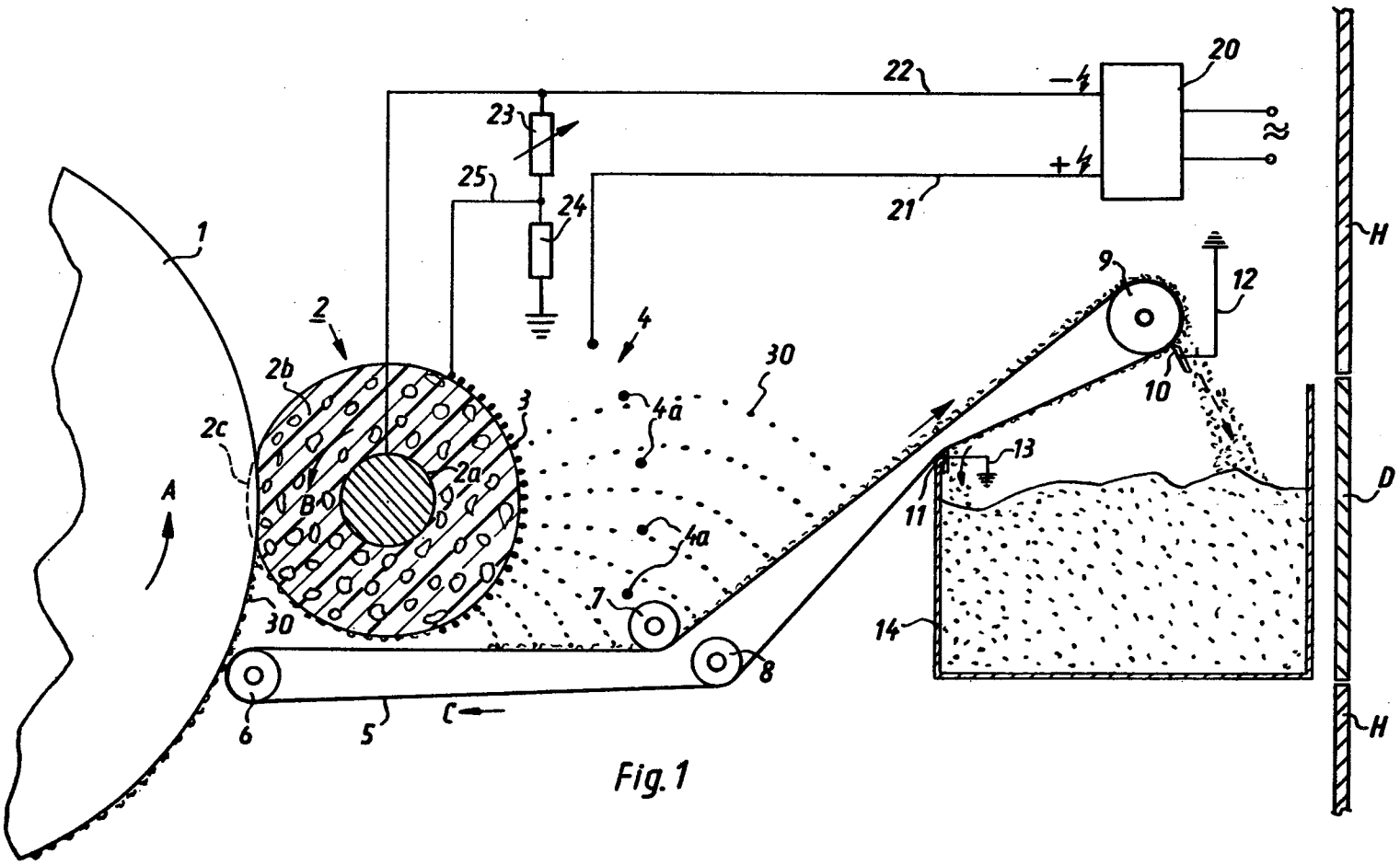
FIG. 1 is a fragmentary, partly sectioned diagrammatic illustration of one embodiment of the invention.

Referring firstly to the embodiment shown in FIG. 1, it will be seen that this Figure illustrates an endless travelling image-forming carrier, here in form of a copy drum 1 which rotates in direction of the arrow A and is mounted in the only fragmentarily shown housing H of an electrostatic copier. The circumference of the drum 1 is provided in the usual manner with a photoconductive surface on which, again in the manner known per se, an electrostatic image pattern can be formed. After toner particles have been electrostatically attracted to this image pattern to form a powder image which is thereupon transferred to an image carrier, e.g., a sheet of copy paper, residual toner particles continue to adhere to the surface of drum 1. These must be removed before the next image pattern is formed.

For this purpose, cleaning means is provided in form of a cleaning roller 2 which is positively driven (by means not shown, because they are known to those skilled in the art) in the direction of the arrow B, i.e., opposite to the direction of rotation of drum 1. This results in incremental portions of the photoconductive surface of the carrier 1 being scrubbed by the cleaning roller 2, whereby the adhering residual toner particles are removed from the drum 1.

The cleaning roller 2 in the embodiment of FIG. 1 has a metallic or otherwise electrically conductive shaft 2*a* on which a sleeve 2*b* of synthetic plastic material is mounted so as to surround and rotate with the driven shaft 2*a*. Sleeve 2*b* is of resiliently compressible cellular synthetic plastic material, for example expanded polyvinylchloride or expanded polystyrene, and the cells or pores of its material are open at the outer peripheral surface of the sleeve so that toner particles can enter into them. The shaft 2*a* is so journalled relative to the drum 1 that the surface of drum 1 and the surface (in undeformed condition) of the sleeve 2*b* would overlap one another by a small extent, e.g., about 2mm, as shown by the phantom line 2*c*, if it were not for the fact that the material of sleeve 2*b* is resiliently compressible. Since the material is, in fact, compressible in this manner, this journalling of shaft 2*a* results in the periphery of sleeve 2*b* being compressed by engagement with the surface of drum 1, in such a way that successive incremental portions of the photoconductive surface of drum 1 are wiped by the sleeve 2*b*.

Figure 3:
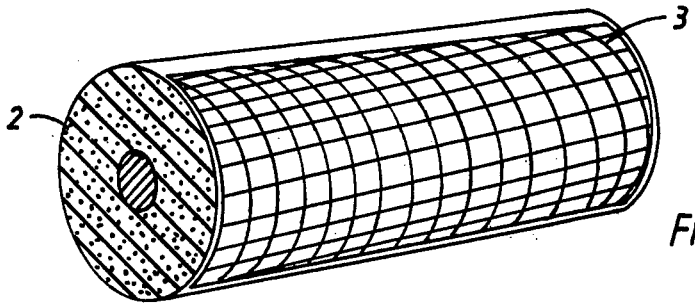
FIG. 3 is a partly sectioned detail view, showing details applicable to both of the preceding embodiments.

Once the residual toner particles have been picked up off the surface of drum 1 by the sleeve 2*b*, they must be removed again from the sleeve 2*b*, since the same would otherwise become fouled with such particles in short order. For this purpose a grid 3 is provided which presses against the surface of sleeve 2*b* at the side roller 2 which faces away from the drum 1. Preferably, the grid 3 extends over substantially the entire axial length of roller 2 and is arcuately curved on a radius of curvature somewhat greater than the radius of curvature of the sleeve 2*b*. As seen in FIG. 3, the wires or rods of the grid 3 extend not parallel to the shaft 2*a*, but are somewhat inclined to the direction of rotation of the roller 2. This grid construction and arrangement relative to the roller 2 assures that the grid 3 is in physical contact with a relatively large part of the surface area of roller 2, and guarantees exceptionally good dislodging of the toner particles from the sleeve 2*a*. Making the radius of curvature of grid 3 somewhat larger than that of the roller 2 prevents the possibility of damage to the surface of sleeve 2*a* by the grid edges. Having the bars inclined to the direction of movement of roller 2 increases the cleaning effectiveness.

The purpose of the grid 3 is, of course, to dislodge toner particles from the sleeve 2*a*, so that they either tend to drop off the surface of the sleeve or are at least shifted on this surface from one position to another, even though such shifting might only be through a small distance, so as to weaken their adherence to the surface.

Figure 4:
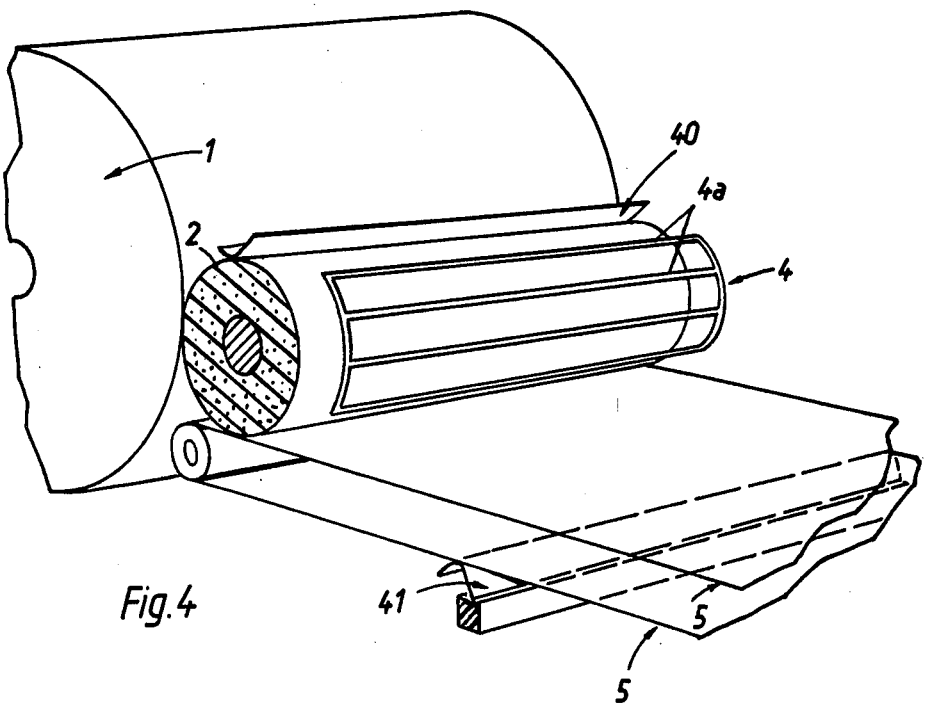
FIG. 4 is a further detail view, also showing details applicable to the respective embodiments of FIGS. 1 and 2.

Once the adherence is weakened, it is desired in accordance with the present invention to remove all of the particles from the vicinity of the roller 2, including those which have been shifted around on the surface of sleeve 2*b* but still continue to cling to it, albeit with greatly reduced adherence. To accomplish this, there is provided an accelerating electrode 4 which is spaced from the grid 3 and is itself in form of a grid (See FIG. 4) composed of longitudinally extending wires or rods 4*a* which extend parallel to the axis 2*a* and to one another and which are electrically conductively connected with each other, e.g., at their ends as shown in FIG. 4. The wires 4*a* are so arranged as to be located on an imaginary cylindrical surface which is concentric with the grid 3.

A conveyor in form of an endless belt 5 is provided. The belt 5 is advantageously of rubberized fabric, or else of natural or synthetic rubber or of synthetic plastic material. Belt 5 is trained about a plurality of rollers 6, 7, 8 and 9, some or all of which are driven, and travels in the direction indicated by the arrow C. The roller 6 is close to the surface of drum 1 and so positioned that the conveyor belt 5 approaches this surface closely, e.g., to a distance amounting to only tenths of a millimeter. At the end of the conveyor formed by the belt 5 which is remote from the drum 1, i.e., at the discharge end, there is provided a receptacle 14 for the toner particles which have been removed from the drum 1. This receptacle 14 is readily accessible from the exterior of the housing H, e.g., through a door D which is provided for this purpose. In the region of the discharge end the belt 5 is engaged by two spaced-apart doctor blades 10 and 11 which are connected to ground potential via conductors 12 and 13, respectively.

A transformer 20 is connectable to net current and has an output for positive high-voltage potential and an output for negative high-voltage potential, as symbolically shown in FIG. 1. A conductor 21 connects the electrode 4 with the positive output and a conductor 22 connects the conductive shaft 2*a* of roller 2 (e.g., at one axial end thereof via not illustrated slip rings) to the negative output of the transformer 20. A voltage divider is composed of two series-connected resistors 23, 24, of which the former may be adjustable; this voltage divider is connected via conductor 25 to the grid 3; it is also connected to the conductor 22 so that the grid is connected to the negative potential of transformer 20 via the voltage divider.

By connecting the grid 3 in the above-described manner with a constant electric potential, the removal of the toner particles from the roller 2 is greatly facilitated. This effect is further enhanced if, as also described above, the conductive core of the roller 2, i.e., here the shaft 2*a*, is similarly connected with a constant electric potential. Although this need not necessarily be the same as that supplied to the shaft 2a, such an arrangement is, of course, the simplest since it requires only a single transformer 20.

Since it is also advantageous for the electrical field produced by the electrode 4 to be as nearly uniform as possible everywhere, the present invention proposes — as already explained earlier — to so construct the electrode 4 that its wires 4a are located on an imaginary cylindrical surface which is concentric, or substantially so, to the roller 2, and hence to the grid 3.

The operation of the embodiment described above, is as follows:

After the powder image has been transferred from the photoconductive surface of drum 1 to an image carrier in the usual manner, residual toner particles 30 continue to adhere to the drum surface. These are wiped off the drum surface by the sleeve 2b of roller 2 and enter the open pores at the surface of sleeve 2b. Those particles 30 which drop off the drum surface fall onto the belt 5 and are immediately transported towards the receptacle 14, i.e., to the right in FIG. 1. This immediate intercepting and removal of these particles offers a particularly effective way of protecting the interior of the copier against the undesired entry of toner particles and resulting fouling of the components with which they come in contact.

Grid 3 compresses successive circumferential portions of the surface of sleeve 2b to a preselected extent, corresponding to about the depth of the open pores at the surface. This is the result of the fact that the grid is in compressive contact with a relatively large area of the sleeve surface. This intermittent compression and subsequent relaxation (as the previously compressed increment passes beyond the grid 3 during continued rotation of roller 2) effects intensive mechanical removal of some of the toner particles from the surface of sleeve 2b. Those particles which are not so removed, i.e., which do not drop off the sleeve surface, are at least shifted about on the surface of the sleeve 2b, to a greater or lesser extent due to the action of grid 3. Even a small, local displacement of such a particle is sufficient, however, to drastically reduce the forces of adhesion holding it on the sleeve surface. This makes it possible for the electric field acting between the electrode 4, the shaft 2a, and the grid 3 to lift the particles off the surface of sleeve 2b. These particles are then accelerated by the high-strength field existing between grid 3 and electrode 4, in direction towards the latter so as to fly in the paths shown in FIG. 1 in direction away from the grid 3. The free movement of the particles beyond (i.e., to the right in FIG. 1) the electrode 4 is not perceptibly hindered by the fact that the electrode 4 extends across the paths of the particles 30, because the electrode is of high transparency, which is to say that the combined surface area of the interstices of the electrode 4 is so great relative to the total surface area of the electrode, that the movements of the particles are not hindered. The particles finally drop onto the conveyor belt 5 which brings them to the receptacle 14 into which they are discharged. Some of the particles tend to adhere electrostatically to the belt 5; to assure that they, also, are removed from the belt there are provided the two doctor blades 10, 11 which strip these particles off the belt and which are grounded to counteract the electrostatic effect.

It has been found that in the embodiment of FIG. 1 optimum results are obtained if the negative potential applied to the shaft 2a is −10KV, the negative potential applied to the grid 3 is −1KV and the positive potential applied to the electrode 4 is +10KV. However, these values should be understood as being exemplary only, since other values can also be used with satisfactory results.

Figure 2:
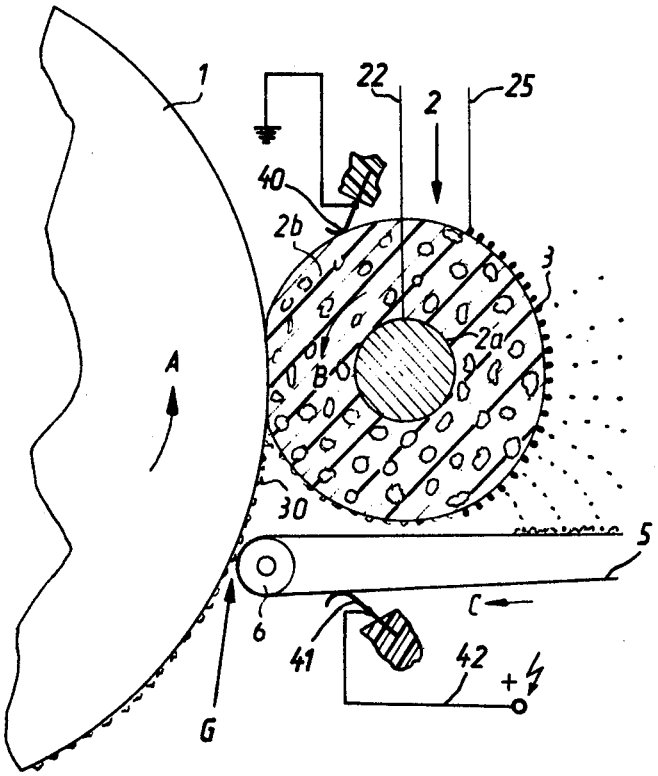
FIG. 2 is a fragmentary detail view, partly sectioned, showing a further embodiment of the invention.

The embodiment shown in FIG. 2 is essentially the same as the one in FIG. 1. Hence, similar elements have been identified with the same reference numerals as in FIG. 1. These elements of FIG. 1 which are not shown in FIG. 2 should nevertheless be understood as being present in FIG. 2, also. The showing of FIG. 3 relative to the orientation of the grid 3 to the roller 2 is also applicable.

The embodiment of FIG. 2 differs from that of FIG. 1 in that a conductive contact member 40 is provided which engages the roller 2 over substantially the entire axial length thereof (see FIG. 4). As shown in FIG. 2, member 40 is connected to ground potential and its purpose is to prevent the surface of roller 2 from having — when its increments reach the area of contact with the surface of drum 1 — a residual negative potential which was impressed upon it by the grid 3. The presence of such a negative potential would cause the — also negatively charged — toner particles to be repelled from the surface of roller 2 and this would noticeably reduce the ability of the roller 2 to pick up residual toner particles 30 from the surface of drum 1.

A further conductive contact member 41 engages the belt 5 over substantially the entire width of the same (see FIGS. 2 and 4) and is connected via conductor 42 with a source of a positive potential of +200 V. The purpose of this measure is to apply a positive charge to the surface of belt 5 so as to establish what might be called an "electric seal" in the gap G which is defined between the surface of drum 1 and the belt 5 at the point of its nearest approach to the drum 1. This further enhances the protection of the interior of the copier against the undesired entry of toner particles through this gap G.

Among the advantages of the present invention are the fact that no consumable material, such as the previously proposed fibrous web, is required. Despite this, however, the toner particles removed from the surface of the drum 1 are removed almost immediately from the cleaning roller 2; this effectively prevents the accumulation of toner particles on the cleaning roller 2 and reliably avoids the re-application of such particles by the roller 2 onto the surface of drum 1.

The embodiments described herein are for purposes of explanation only and should not be considered limiting. They can be modified in a variety of ways within the scope and intent of the appended claims.

Thus, it would be possible to omit the conveyor belt 5 and to have the field produced by electrode 4 in conjunction with grid 3 and shaft 2a drop the particles directly into the receptacle 14. However, the latter would then have to be closer to the roller 2 and could not be readily positioned in such a manner as to be easily accessible from without the copier, as is the case when the conveyor belt 5 is employed to bring the particles to the receptacle 14. Also, the use of the belt 5 offers better protection of the interior of the copier against the undesired entry of toner particles than would be possible in its absence.

It will be understood that each of the elements described above, or two or more together, may also find a useful application in other types of applications differing from the types described above.

While the invention has been illustrated and described as embodied in an electrostatic copier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an electrostatic copier wherein an electrostatic image pattern is formed on the photoconductive surface of a travelling endless carrier, toner particles are electrostatically attracted to said pattern to form a visible image and are thereupon transferred to an image carrier, and cleaning means subsequently cleans incremental portions of the photoconductive surface to remove residual toner particles therefrom which then become lodged on said cleaning means, the improvement comprising means for dislodging toner particles from said cleaning means; a receptacle spaced from said dislodging means; a grid-electrode intermediate said receptacle and said dislodging means and spaced from the latter, said grid-electrode being provided with a plurality of interstices so as to be readily permeable to toner particles; and means connected to said grid-electrode for generating between the same and said dislodging means an electric field which impels dislodged particles from said dislodging means towards and through said grid-electrode for eventual deposition in said receptacle.

2. The improvement defined in claim 1, wherein said cleaning means comprises a cleaning roller having an axis of rotation extending parallel to said photoconductive surface transverse to the direction of travel thereof, and a circumferential face in wiping contact with said photoconductive surface.

3. The improvement defined in claim 2, wherein said dislodging means comprises an element for mechanically dislodging toner particles from said cleaning roller.

4. The improvement defined in claim 2, wherein said dislodging means comprises an element in mechanical engagement with said circumferential face of said cleaning roller.

5. The improvement defined in claim 2, wherein said dislodging means comprises a grid-shaped element.

6. The improvement defined in claim 2, wherein said dislodging means comprises a grid-shaped element surrounding said circumferential face over a portion of arc in mechanical engagement therewith.

7. The improvement defined in claim 6, wherein said grid-shaped element is arcuately curved on a radius of curvature which is greater than the radius of curvature of said circumferential face.

8. The improvement defined in claim 1; further comprising a source of constant voltage; and means connecting said source with said dislodging means.

9. The improvement defined in claim 1; further comprising a source of constant voltage; and wherein said cleaning means comprises a cleaning roller having an electrically conductive core which is conductively connected with said source.

10. The improvement defined in claim 9, wherein said core is metallic.

11. The improvement defined in claim 10, wherein said grid-electrode has a radius of curvature larger than and concentric to said cleaning roller.

12. The improvement defined in claim 1, said plurality of interstices having a combined surface area which constitutes a predominant portion of the surface of said grid-electrode.

13. The improvement defined in claim 1; and further comprising an endless conveyor extending in part beneath said cleaning means and said grid-electrode for intercepting toner particles dropping off said cleaning means.

14. The improvement defined in claim 13, said conveyor having a discharge station located above said receptacle so as to discharge into the same.

15. The improvement defined in claim 13, wherein said conveyor comprises an endless belt, and a plurality of rolls about which said belt is trained.

16. The improvement defined in claim 15, said conveyor having a portion located closely adjacent to said photoconductive surface and defining a gap with the same.

17. The improvement defined in claim 13, said conveyor comprising a belt and having a discharge station positioned to discharge into said receptacle; and further comprising at least one doctor blade engaging said belt at said discharge station.

18. The improvement defined in claim 17; and further comprising means connecting said doctor blade to ground potential.

19. The improvement defined in claim 1, said cleaning means comprising a cleaning roller having an axis of rotation parallel to said surface and extending transverse to the direction of travel thereto; and further comprising an electrically conductive contact element connected to ground potential and engaging said cleaning roller at a location intermediate said photoconductive surface and said grid-electrode, as considered in the direction of rotation of said cleaning roller.

20. The improvement defined in claim 19, wherein said contact element engages said cleaning roller over substantially the axial length thereof.

21. The improvement defined in claim 1; and further comprising a conveyor extending from the vicinity of the photoconductive surface to said receptacle and positioned to intercept the dislodged residual toner particles and convey them to said receptacle.

22. The improvement defined in claim 21, said conveyor comprising a belt having a working run extending from the vicinity of said surface to said receptacle, and a return run extending from said receptacle to said vicinity; and further comprising an electrically conductive contact member connected to a constant electrical potential and engaging said return run over substantially the entire width of said belt.

* * * * *